United States Patent [19]

Krabbe

[11] 4,332,508

[45] Jun. 1, 1982

[54] SHIELD FOR TUNNELING AND MINING

[75] Inventor: Wilfried Krabbe, Dreieich-Buchschlag, Fed. Rep. of Germany

[73] Assignee: Philipp Holzmann Aktiengesellschaft, Frankfurt am Main, Fed. Rep. of Germany

[21] Appl. No.: 124,216

[22] Filed: Feb. 25, 1980

[30] Foreign Application Priority Data

Feb. 28, 1979 [DE] Fed. Rep. of Germany ..... 2907768

[51] Int. Cl.[3] ..... E21D 9/06

[52] U.S. Cl. ..... 405/144; 405/145

[58] Field of Search ..... 405/141, 142, 144, 145; 299/31, 33

[56] References Cited

U.S. PATENT DOCUMENTS

| | | | |
|---|---|---|---|
| 2,757,515 | 8/1956 | Wilbur et al. | 405/142 |
| 3,260,054 | 7/1966 | Lorenz | 405/144 X |
| 3,378,305 | 4/1968 | Geldmacher et al. | 299/33 |
| 3,613,383 | 10/1971 | Fiske | 405/144 |
| 4,203,626 | 5/1980 | Zokor et al. | 299/33 |

*Primary Examiner*—David H. Corbin

*Attorney, Agent, or Firm*—Scully, Scott, Murphy & Presser

[57] ABSTRACT

A shield arrangement used for tunneling and mining in which a work chamber has an open front side located at the work face from which material is to be removed in tunneling and mining operations. Pressure is admitted into the work chamber for supporting the work face against crumbling and collapse. The work chamber also has supporting elements for the work face, which are selectively movable into and out of an operative position in which they support the work face. These selectively movable supports serve to replace at least partially, the support provided by the pressure medium admitted into the work chamber. The chamber has a longitudinal axis normal to the open side of the supporting elements which may be in the form of plates.

18 Claims, 6 Drawing Figures

SHIELD FOR TUNNELING AND MINING

BACKGROUND OF THE INVENTION

The present invention relates to a shield for tunneling and mining applications.

More particularly, it relates to a shield of the aforementioned type when a tool for removing material from the tunnel of a mine face (hereafter called the work face for convenience) is arranged in a work chamber of the shield.

Shields of this type constitute a screen which protects the workers and the material-removing equipment as material is removed from the work face, and the shield is pushed forward as the work advances. The shield may, as in the present invention, be cylindrical and include the entire tunnel section; in this case it has at the front a work chamber which is open at its leading end to the work face i.e. to the material to be removed, and which at its rear end is closed by a transverse wall behind which there is located a tunnel cladding, for example in the form of ring segments which are installed as the shield moves forward.

A shield of this general type is known from German Pat. No. 2,431,512. It has the material-removing equipment located in the working chamber and the working chamber itself is filled with a pressure medium in which the material-removing equipment works. The purpose of this pressure medium is to support the work face i.e. to prevent the material at the work face from crumbling or even collapsing if the mine gallery or tunnel is being driven through loose material, rather than through e.g. solid rock.

The prior-art shield is rather satisfactory; however, it has been found that it may become necessary for personnel to enter the work chamber at times. This necessity may arise if, e.g. some obstruction is encountered in the material of the work face which cannot be readily removed by the material-removing equipment, for example large rocks, tree trunks or parts of sunken habitations. If that occurs it is necessary, in the prior-art shield to remove the pressure medium e.g. a thixotropic liquid, before the workers can enter the chambers. With the removal of the pressure medium, of course, the protection against a possible collapse of the work face is removed with the result that during manual disengagement of the obstruction in question the danger exists that the work face might collapse and possibly cause injuries or even death among the workers in the work chamber.

SUMMARY OF INVENTION

It is an object of the present invention to overcome this disadvantage of the prior art.

A more particular object of the invention is to provide an improved shield of the type in question, i.e. for tunneling and mining purposes, which is not possessed of the aforementioned drawback.

A still more particular object of the invention is to provide a shield of the type in question wherein personnel can freely and safely enter the work chamber without having to fear collapse of the work face even though the work face is not being supported by pressure medium.

In keeping with these objects, and with still others which will become apparent hereafter as the description proceeds, one aspect of the invention resides in a shield for tunneling and mining which, briefly stated, may comprise means forming a work chamber having a open front which in use is located at the work face from which material is to be removed, and means in the work chamber for removing material from the work face. Means are provided for admitting into the work chamber a pressure medium which supports the work face against crumbling and collapsing and, in accordance with the invention, there are provided work face supporting elements mounted in the chamber and being selectively movable into and out of an operative position in which they support the work face in at least partial replacement of the support afforded by the pressure medium.

Embodiments of the invention are illustrated in the drawing which is to be discussed hereafter. The invention itself, however, is defined exclusively in the appended claims and the illustrated embodiments are not be considered limiting in any sense.

DESCRIPTION OF PREFERRED EMODIMENTS

Figure 1:
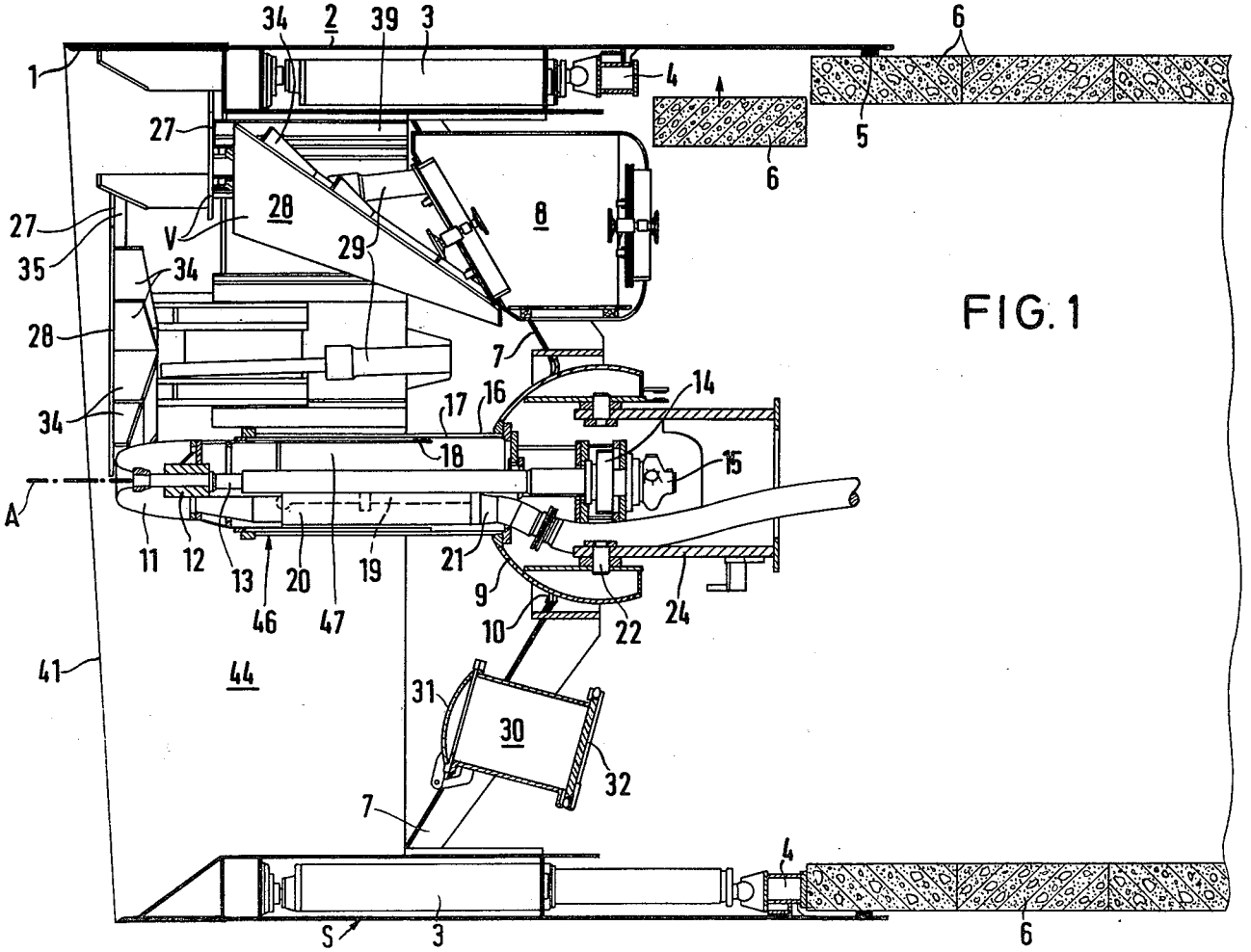
FIG. 1 is a longitudinal section of a shield according to the present invention, the section being taken on line I—I of FIG. 2.
Figure 2:
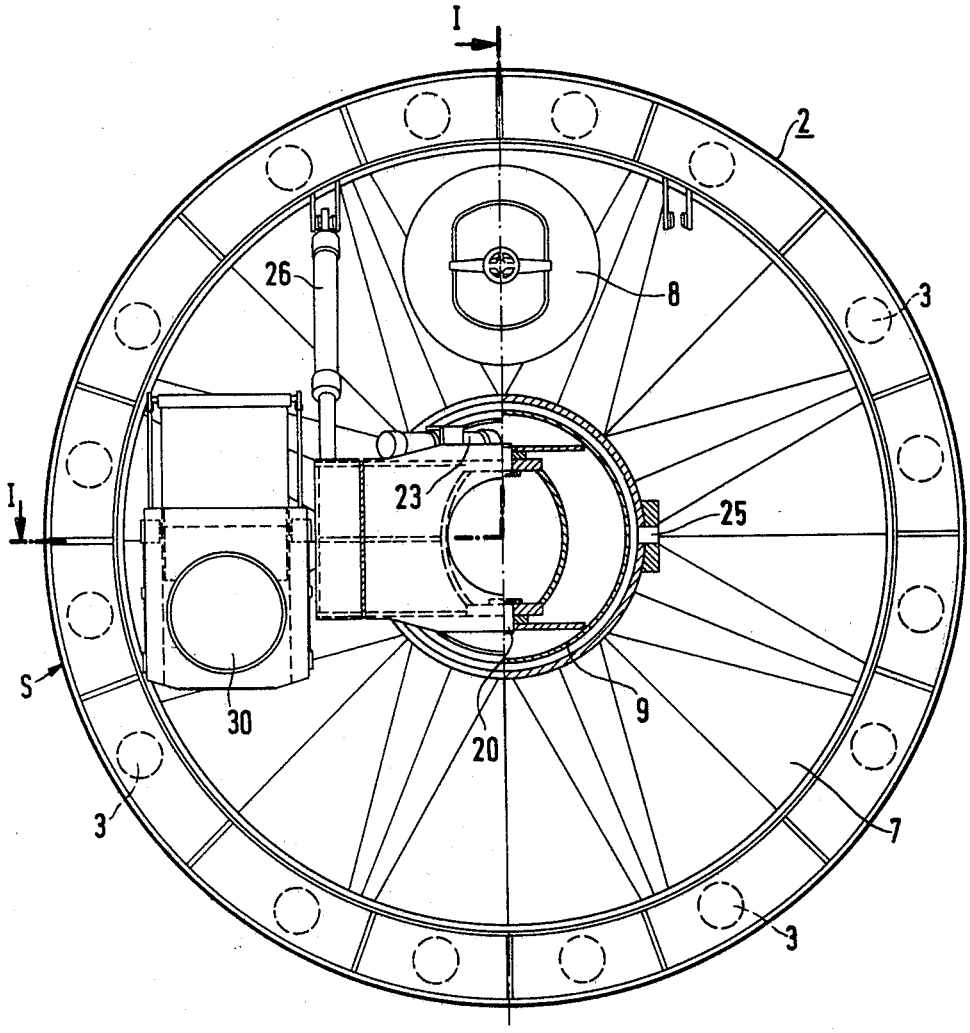
FIG. 2 is an end view of the shield, looking towards the left in FIG. 1.
Figure 3:
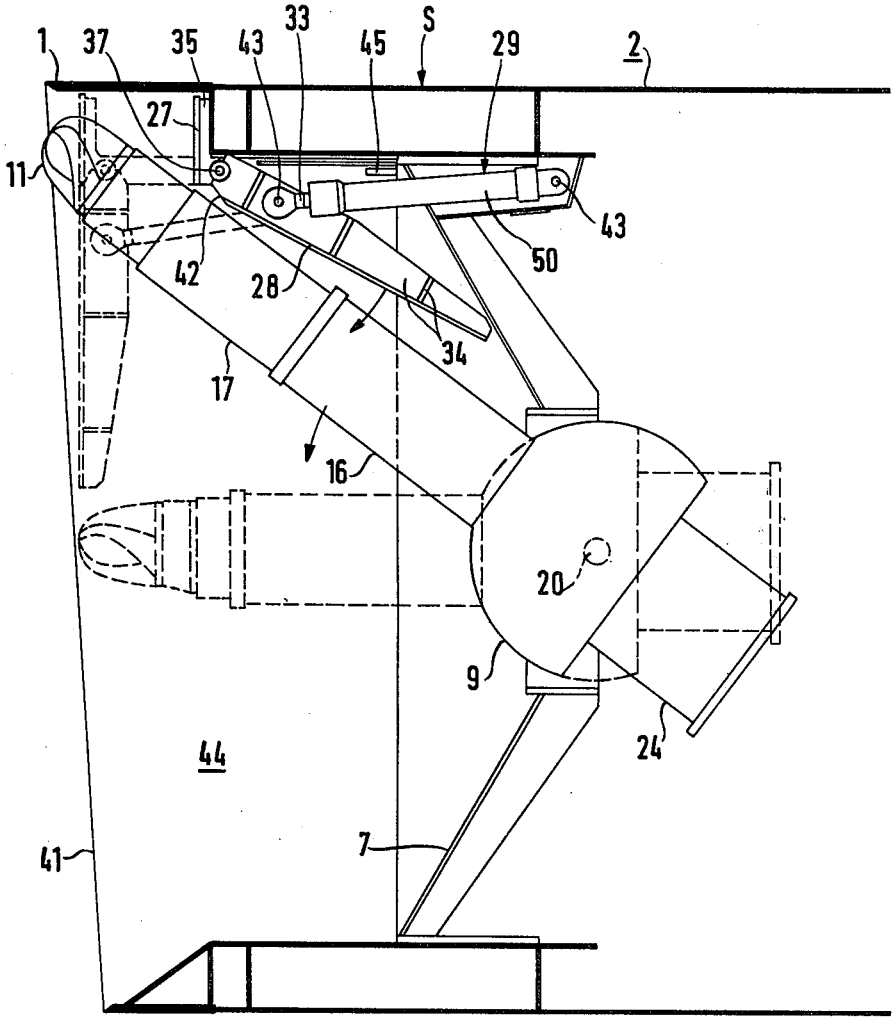
FIG. 3 is a section taken on line III—III of FIG. 2.

Referring now to FIGS. 1–6 it will be seen that reference numeral 2 identifies the outer circumferential wall of the shield S according to the present invention. This circumferential wall is a double wall having a front edge 1 which is doubled so as to almost form a cutting edge and which surrounds a free forward side or end of a working chamber 44 of the shield, which working chamber is closed at its rear end by a transverse wall 7. Reference numeral 1 identifies diagramatically the work face i.e. the tunnel face or the mine face from which material is to be removed. The edge 1 tightly engages the work phase 41 so as to establish a type engagement therewith, permitting the chamber 44 in operation to be filled with a pressure medium, preferrably a thixotropic liquid, which serves to support the material of the work face 41 against crumbling and collapse. Mounted in the chamber 44 is a material-removing device 46, e.g. a cutting device which removes material from the work face 41. An inlet 45 is provided in the upper part of the transverse wall 7 through which the pressure medium can be introduced into the working chamber 44 wherein it is held—during operation of the device 46—at a certain pressure and, to the extent that some of the pressure medium escapes (e.g. at the edge 1) additional material is admitted through the inlet 45 in order to maintain the quantity and pressure of such material in the chamber 44 as constant as possible.

The material removal device 46 has an arm 47 which is movably mounted in the chamber 44 and carries at its front end a cutting tool 11 which is constructed as a cutting head turnable about the longitudinal axis of the arm 47. The arm 47 is universally pivotably mounted in the center region of the transverse wall 7 by means of a universal pivot mount. To permit the required rotatability the cutting head forming the cutting tool 11 is journaled by means of a drive shaft 13 in a front bearing 12 and a rear bearing 14 of the arm 47. The drive of the shaft 13 is effected e.g. a hydraulic motor 15. The universal pivot joint may be provided with a sealing calotte line and a seal 10 cooperating therewith.

Located behind the shield S is the tunnel cladding which is composed of a series of axially adjacent rings 6, and in the upper part of FIG. 1 the left-most ring 6 is shown in the position which it assumes shortly before it reaches its final installed position. A tail seal 5 is provided to seal the circumferential wall 2 with reference to the respectively foremost one of the rings 6. Located in front of the respectively foremost ring 6 is a pressure ring 4 against which hydraulic or pneumatic cylinder and piston units 3 react, the front of which bear against a radial abutment 48 of the wall 2 in the vicinity of the edge 1. It is these units 3 which serve to push the shield S forward as the removal of material from the work face phase 41 proceeds.

The universal pivot joint mounts the arm 47 pivotable in a manner similar to the manner described in the aforementioned German Pat. No. 2,431,512, i.e. such that the cutting head forming the cutting tool 11 can move over the entire surface area of the work face 41. For this purpose the arm 47 can be telescoped to adjust its length with the aid of a cylinder tube 17, a piston tube 18 and an advancing cylinder and piston unit 19. A protective tube 16 surrounds the cylinder tube 17. To facilitate movement of the tool 11 over the entire surface area of the work face 41 there are further provided a pivot 22 which permits horizontal pivoting of the arm 47, a cylinder and piston unit 23 which effects such horizontal pivoting, a pivot 25 on the wall 7 and permitting vertical pivoting of the arm 47, and a cylinder and piston unit 26 which effects such vertical pivoting in conjunction with a vertically pivotable frame 24. The cylinder and piston units 23 and 26 may be hydraulic or pneumatic units and are controlled from a prosition behind the wall 7 (the position is not illustrated), i.e. in the pressure-free area of the shield. Immediately adjacent to the cutting tool 11 there is provided in or on the arm 47 a material removal tube 20 which extends rearwardly to and communicates with a rear material removal tube 21. The material removed from the mine face 41 and mine face pressure medium are picked up in the tube 20 immediately at the location where the tool 11 has removed the material, and are withdrawn through the tubes 20 and 21, to be deposited on a not-illustrated conveying device located rearwardly of the wall 7 which then removes the material to another location. The tubes 20 and 21 are so constructed and arranged that they do not interfere with the free movement of the arm 47.

Forwardly of the transverse wall 7 there are provided, according to the present invention, work face-supporting elements V which are mounted on the shield S and movable from a rest position in which they are retracted and are not in contact with the work face 41, to a working or operating position in which they are extended and do supportingly engage the work face 41. The rest position of the elements V is assumed when the tool 11 operates and the working position is generally assumed when the tool 11 is not in operation.

According to the invention the elements V are in form of plates which are each of two parts. One part 27 extends transversely to the longitudinal axis A of the cylindrical wall 2 (intense of the chamber 44) and is shiftable in lengthwise direction of the axis A. The second part 28 of the respective member V is pivotably connected to the first part 27 so as to be able to pivot relative to the same about a pivot axis 37 to and from a position in which it is co-planar with the part 27. After the part 27 has been advanced to operative position, i.e. usually until it reaches an abutment, the second part 28 is pivoted to operating position and this pivoting continues until pivoting is prevented by engagement with an abutment 42 at which time the part 28 is coplanar with the part 27 so that the entire element V is in operating position.

Figure 5:
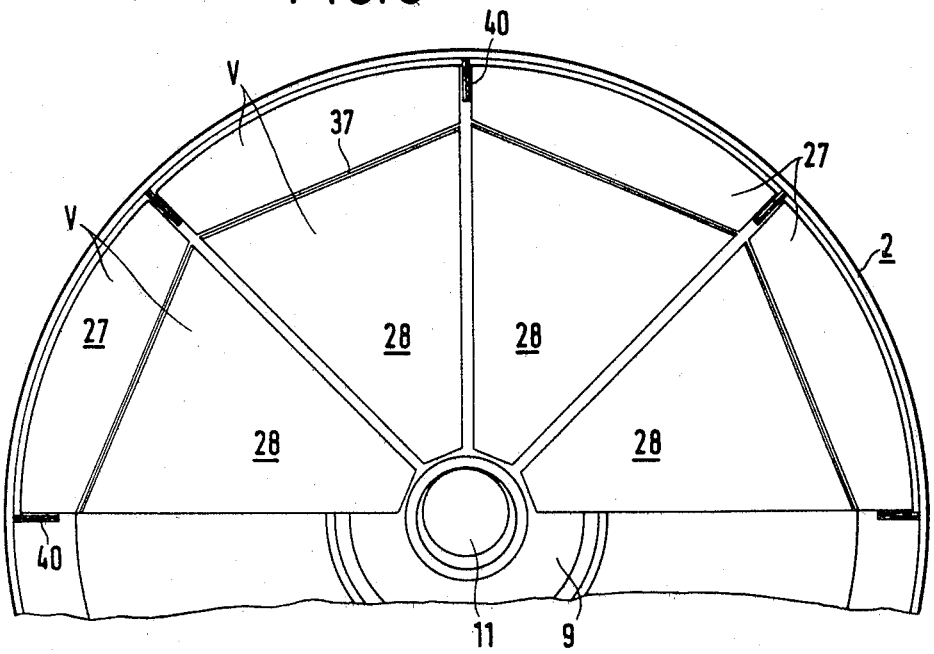
FIG. 5 is a view similar to FIG. 4, but showing the work face supporting elements in their operative position.

When the parts 27 and 28 are in co-planar operating position, the respective element V defines a segment of a circle, as shown particularly in FIGS. 1 and 5.

In most applications of the shield it will suffice if the elements V are located only in the upper half of the cross section of the chamber 44. The reason for this is that in the lower half of the cross section of the chamber 44 there are usually heaps of material which rest against the work face 41 and which not only counteract crumbling and collapse of the work face 41 in the lower half but also would tend to prevent proper movement of the elements V to their operating position.

Figure 4:
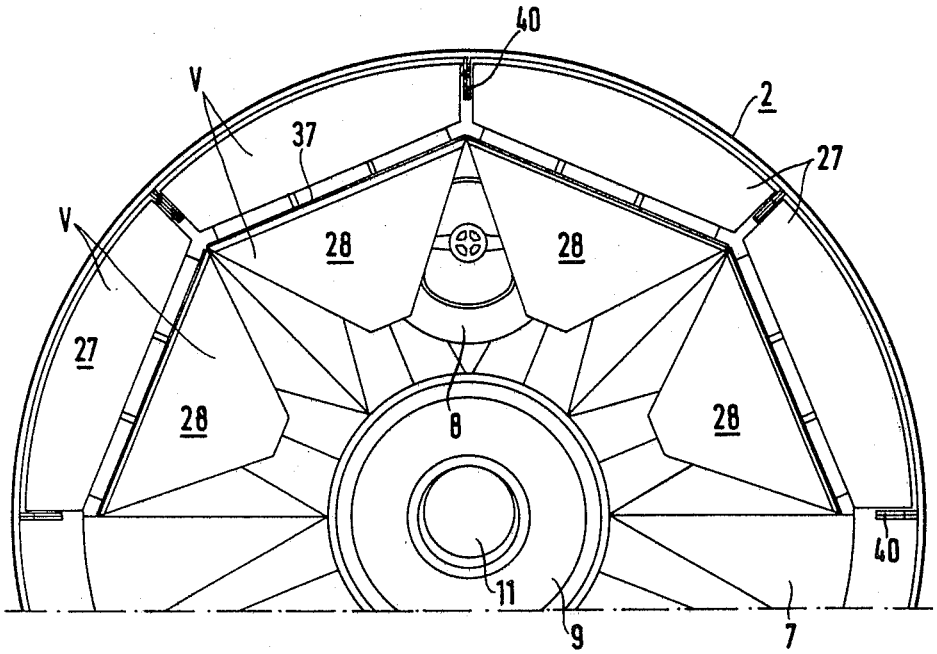
FIG. 4 is fragmentary end view of the shield according to the invention, looking towards the right in FIG. 1 and with the work face supporting elements in their rest position.

It has been found advantageous if, as shown in FIGS. 4 and 5, for preferably identically dimensioned elements V are provided in the region of the upper half of the cross section of the chamber 44. The pivot axis 37 at which the two partial plates 27 and 28 of each element V are pivoted together, should preferably extend along a secant of the shield cross section. The part 27 which is shiftable lengthwise of the axis A advantageously has the form of a modified ring segment with a straight-line inner edge along which the pivot axis 37 extends. The second partial plate 28, i.e. the one which is articulated to the slidable part 27, should advantageously have the shape of a triangle the tip of which extends—when the partial plate 28 is in the operating position shown on FIG. 5—towards the center of the shield cross section whereas in the rest position (FIG. 4) this tip faces towards the rear part of the shield.

Figure 6:
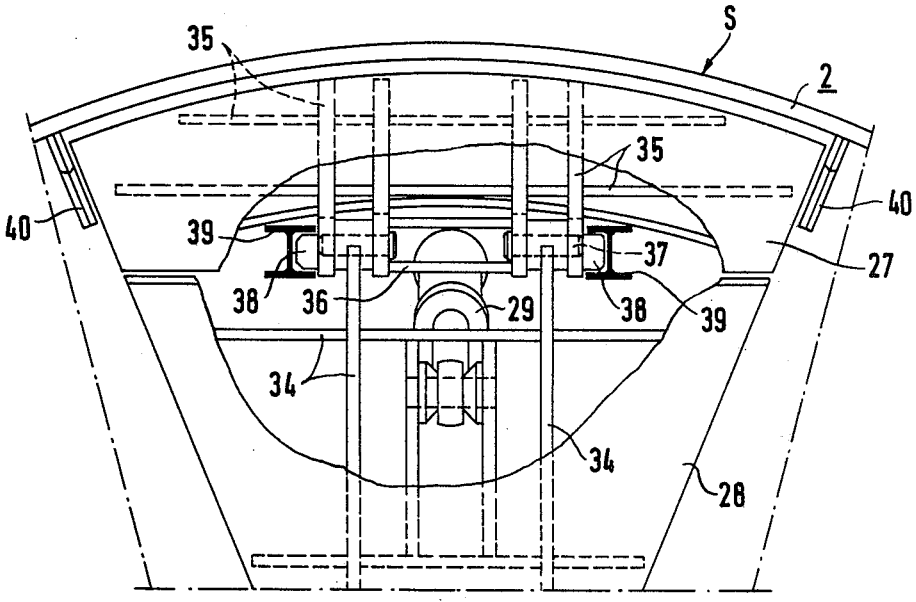
FIG. 6 is a fragmentary, partly broken-away view looking towards the rear chamber wall and showing details of a work face supporting element in front of the same.

The operation of the device, particularly as concerns the movement of the elements V towards and away from the work face 41, is particularly simple if, as shown in FIG. 1 the shiftable partial plate 27 has projections 38 which are engaged in rails 39 extending parallel to the longitudinal axis A. In lieu of this, or in addition thereto, the respective partial plates 27 may be provided with lateral guides 40. Furthermore, and as also shown in FIG. 6, optimum support of the working face 41 makes it desirable to provide a cylinder and piston unit which is connected between the shield S and the respective partial plate 28. According to FIG. 3 these units 29 may be connected at one end to an inner ring-like component 49 of the shield wall 2, and the other end may be connected to the respective plate 28 adjacent to the pivot axis 37 thereof. The tilting axes 43 at which the cylinder and piston units 29 are articulated to the component 49 and to the respective partial plate 28 should extend parallel to the respective pivot axis 37. When, after the piston rod 33 of the respective cylinder and piston units 29 has been extended, the end of the piston rod which is the left one in FIG. 3 abuts against the right end of the piston 50, this constitutes the abutment for the pivoting of the partial plates 28.

The arrangement of the partial plates 27, 28 which in pairs from the respective elements V is such that the elements together cover the upper half of the shield cross section (compare FIG. 5) when the respective second partial plates 28 have been fully extended to operative position, i.e. until they abut the respective abutment 42.

The upper part of the wall 7 is provided with a lock or port 8 through which personnel can enter the chamber 44 after the elements V have been moved to operating position in which they support the working face 41 and the pressure of the pressure medium in the chamber 44 has been dissipated or at least reduced. The lower part of the wall 7 is provided with a lock or port 30 for entry or removal of material. It is advantageous if the partial plates 27 and 28 of each element V are provided, preferably on their rear sides, with reinforcing ribs 34 and 35, respectively.

With a shield constructed according the present invention personnel can enter and work in the chamber 44 without danger of injury of loss of life. It is merely necessary, when it has been found that an obstacle is present at or in the work face 41 which requires manual inspection and/or removal, to move the elements V to a position in which they support at least the upper half of the area of the work face 41 and to lower the pressure of the pressure medium or else to remove the pressure medium entirely. The personnel can now enter without danger through the port 8. If the pressure medium is a thixotropic liquid, it is necessary only to remove sufficient of the liquid so that the level of the liquid is no higher than about half the height of the chamber 44. The worker or workers in the chamber 44 now inspect the work face to locate the particular obstacle and, after this obstacle has been so located, that one of the elements V which covers it at this time is retracted so that the obstacle can now be removed in one piece or can be broken up, whereupon it can be taken out of the chamber 44 through the port 30. It goes without saying that the cutting device 46 will not be in use when personnel enters the chamber 44, and may have to be retracted to a position in which it does not interfere with the working of involve the personnel at the work face 41. During the removal of the obstacle the remainder of the work face 41 remains covered and supported by the other elements V. It will be appreciated that the invention is useful not only for the removal of obstacles from the work face 41, but also to permit repairs of e.g. the cutting tool 11 or other parts within the chamber 44, without having to laborously dismount these parts and take them out of the chamber for repairs, inspection or other maintenance.

The invention has hereinbefore been described with reference to exemplary embodiments. The protection sought for it, however, is to be considered as defined exclusively the appended claims.

I claim:

1. A shield for tunneling and mining, comprising means for forming a work chamber having an open front which in use is located at the work face from which material is to be removed; means in said work chamber for removing material from the work face; means for admitting into the work chamber a pressure medium which supports the work face against crumbling and collapse; and work face supporting elements comprising rack elements interiorly supported and positioned within said work chamber in spaced relation to said work face, said elements being movable within said work chamber so as to engage and be supported against said work face; said elements having a first and a second part, said first part, when in the interiorly supported position, being positioned transverse to the longitudinal axis of the cylindrical shield and said first part longitudinally displaceable relative to said shield axis; said second part being pivotable relative to said first part said elements being selectively movable into and out of an operative position in which they support the work face in at least parallel replacement of the support afforded by said pressure medium.

2. A shield as defined in claim 1, wherein said supporting elements comprise supporting plates.

3. A shield as defined in claim 1; further comprising abutment means limiting the pivoting of said second part relative to said first part.

4. A shield as defined in claim 1, said two parts of the respective plate being located in a radial plane of said chamber when said second part is located in the general plane of said first part, and together defining a segment of a circle when so located.

5. A shield as defined in claim 1, said chamber being of circular cross-section and having a longitudinal axis normal to said open side and an upper and a lower half which are respectively located above and below said longitudinal axis; and wherein said supporting elements are located only in said upper half.

6. A shield as defined in claim 5, said elements including four supporting plates each comprising two parts which are pivoted together for relative movement about a pivot axis extending along a secant of said circular cross section.

7. A shield as defined in claim 6, a first one of each of said two parts being movable relative to said longitudinal axis and having the shape of a partial circle with a radially inner straight edge portion, said pivot axis extending along said straight edge portion.

8. A shield as defined in claim 7, said second part comprising a plate having substantially the shape of a triangle provided with a tip which faces towards the center of said work chamber when the respective element is located in said operative position.

9. A shield as defined in claim 1, said elements being plates and each composed of a first part and a second part which is pivoted to said first part; further comprising guide rails on said work-chamber forming means and extending lengthwise of a center longitudinal axis of the same; and means on said first parts engaged with said rails so that said first parts are slidable towards and away from said open side.

10. A shield as defined in claim 9, and further comprising lateral guides for the respective first parts.

11. A shield as defined in claim 1, said elements being supporting plates each composed of a first part mounted on said working-chamber forming means and a second part articulated to the respective first part for movement about a pivot axis; and further comprising cylinder and piston units each connected between the respective second part and said working-chamber forming means.

12. A shield as defined in claim 11, wherein said working-chamber forming means includes a circumferential chamber wall; and wherein the respective cylinder-and-piston units are connected to said chamber wall and to the respective second part adjacent the pivot axis thereof.

13. A shield as defined in claim 12, wherein the cylinder-and-piston units are articulated to said circumferential wall and to the respective second part for movement about tilting axes which extends parallel to said pivot axes.

14. A shield as defined in claim 1, said chamber having a longitudinal center axis normal to said open side and dividing the chamber cross section into an upper part and a lower part; said elements being located in said upper part and comprising plates each having a first part mounted on said chamber-forming means and a second part articulated to the first part for pivoting relative thereto into and out of said operative position; and wherein said second parts together cover the cross-section of said upper part when in said operative position.

15. A shield as defined in claim 1, said chamber-forming means including a transverse wall remote from said working chamber and closing the same off from a rearward part of the shield; and further comprising a port in such transverse wall.

16. A shield as defined in claim 15, wherein said port is a personnel access port.

17. A shield as defined in claim 15, wherein said port is a material movement port.

18. A shield as defined in claim 1, said elements being plates each composed of two relatively pivotably parts; and further comprising reinforcing ribs on said parts.

* * * * *